US005273507A

United States Patent [19]

Sivula

[11] Patent Number: 5,273,507

[45] Date of Patent: Dec. 28, 1993

[54] MUSCLE EXERCISER

[76] Inventor: Desirée Sivula, Museokatu 21 A 6, SF-00100 Helsinki, Finland

[21] Appl. No.: 910,740

[22] Filed: Jul. 8, 1992

[51] Int. Cl.[5] ..... A63B 21/05

[52] U.S. Cl. ..... 482/126; 482/122; 482/128

[58] Field of Search ..... 482/49, 121 ∝ 130, 482/108

[56] References Cited

U.S. PATENT DOCUMENTS

| | | | |
|---|---|---|---|
| 3,167,312 | 1/1965 | Blanchard | 482/128 |
| 4,076,237 | 2/1978 | Dussia | 482/121 X |
| 4,211,405 | 7/1980 | Blowsky et al. | 482/128 |
| 4,240,624 | 12/1980 | Wilson | 482/49 |
| 4,519,605 | 5/1985 | Leland | 482/130 X |
| 4,690,399 | 9/1987 | Hayashi | 482/108 |
| 4,946,161 | 8/1990 | Cantieni-Habegger et al. | 482/121 X |

FOREIGN PATENT DOCUMENTS

| | | | |
|---|---|---|---|
| 440503 | 1/1936 | United Kingdom | 482/128 |

*Primary Examiner*—Robert Bahr

*Attorney, Agent, or Firm*—Armstrong, Westerman, Hattori, McLeland & Naughton

[57] ABSTRACT

A muscle exerciser intended for compression between the hands and suited to the exercise of, e.g., the muscles of the chest, neck and shoulder region by various compressive movements, the exerciser being comprised of two cup-shaped compression caps suited to fit the palms, two parallel frame flanges on which the compression caps are mounted and anchoring rods placed between said frame flanges so as to keep the frame flanges parallel and to permit a certain length of axial approach of the frame flanges. The gap between the frame flanges is filled by an element of resilient expanded plastic material capable of keeping the frame flanges pushed to their extreme positions and bestowing the exerciser a resiliently yielding movement when the compression caps are pushed toward each other.

8 Claims, 2 Drawing Sheets

MUSCLE EXERCISER

The present invention relates to a muscle exerciser intended for compression between the hands and suited to the exercise of, e.g. the muscles of the chest, neck and shoulder region by various compressive movements, said exerciser being comprised of two cup-shaped compression caps shaped to fit the palms, two parallel frame flanges on which said compression caps are mounted and anchoring rods placed between said frame flanges so as to keep the frame flanges parallel and to permit a certain length of axial approach of said frame flanges. Conventional exercisers generally incorporate metallic coiled springs, whose disadvantages are high production costs, difficult assembly, high weight and material cost.

It is an object of the present invention to provide a novel type of muscle exerciser free from the above-described disadvantages. The muscle exerciser according to the present invention is characterized in that the material between the frame flanges is resilient expanded plastic capable of keeping the frame flanges pushed to their extreme positions and resiliently yielding movement of the exerciser when the compression caps are pushed toward each other. Thus, the present muscle exerciser is vastly superior to all prior-art exerciser devices due to its simpler production, lighter weight and, therefore, lower production cost. Tests have proved expanded plastic to be a suitable material for the resilient element that provides appropriate resistance to the compressive forces of the exercise movements.

A preferred embodiment of the invention is characterized in that the element of expanded plastic material is comprised of multiple superimposed discs (4) of expanded plastic that in combination form the resilient element. The expanded plastic discs of the resilient element can be cut from sheets of differing color, thereby resulting in a visually pleasing striped look of the exerciser.

Figure 1:
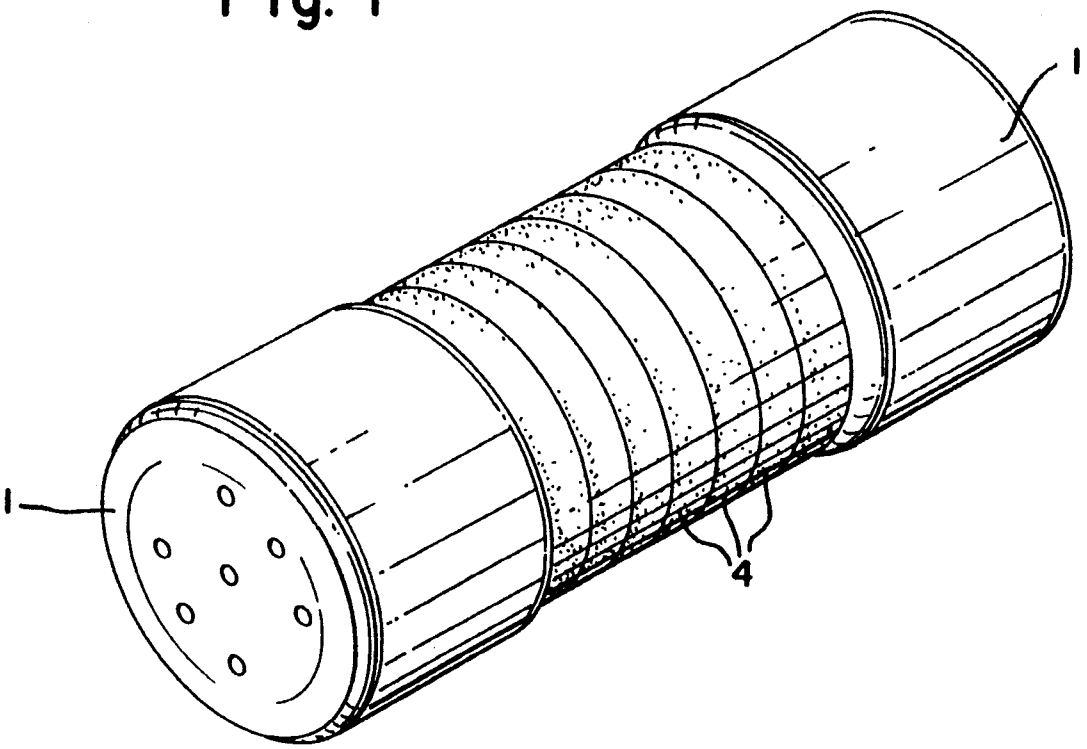
Figure 2:
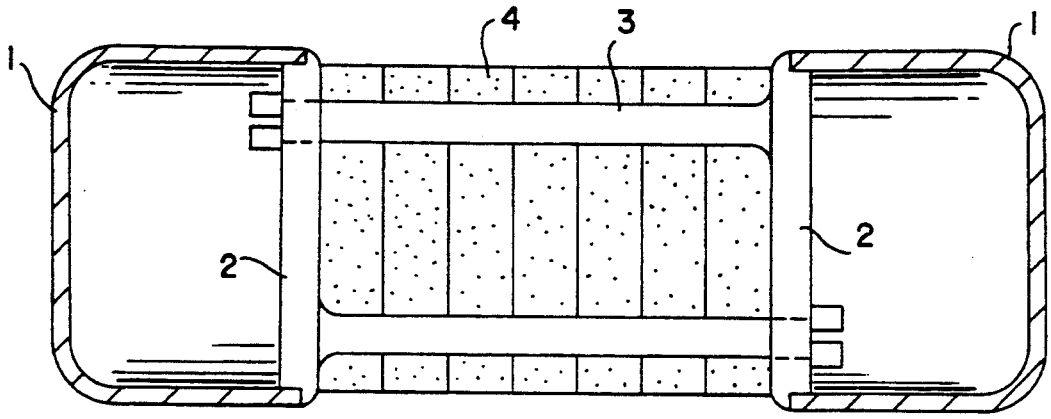
Figure 3:
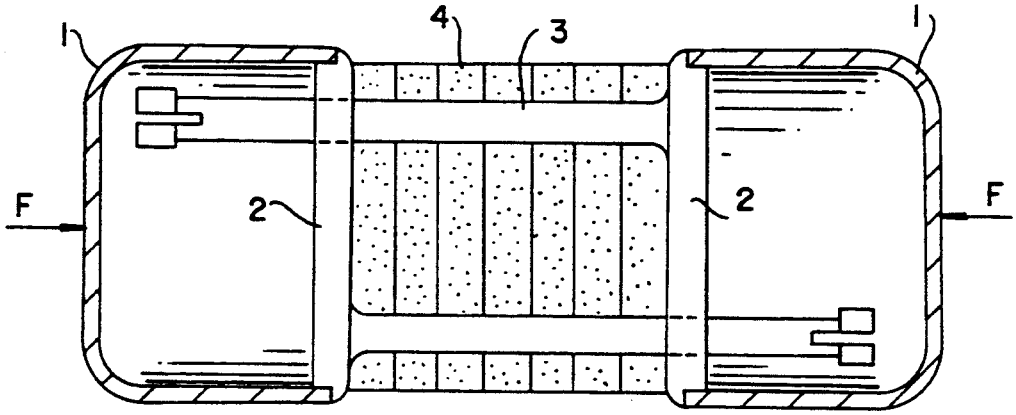

In the following, the invention is examined with the help of an exemplifying embodiment by making reference to the attached drawings, in which FIG. 1 shows an exerciser according to the invention in an axonometric view, FIG. 2 shows the same exerciser in a sectional view, and FIG. 3 shows the same view as the diagram of FIG. 2, now the exerciser being under a certain compressive force F.

The exerciser is comprised of two cup-shaped compression caps 1 and two parallel frame flanges 2, on which said compression caps are mounted. Between the frame flanges 2 are mounted anchoring rods 3 which keep the frame flanges parallel and permit a certain length of axial approach of said frame flanges 2. Due to reasons of diagrammatic presentation, only two anchoring rods are shown in FIGS. 2 and 3, while the practical number of the rods is six evenly outdistanced along a circle. The space between the frame flanges 2 is filled with resilient expanded plastic 4 capable of pushing the frame flanges 2 to their extreme positions and bestowing a springed movement to the exerciser when the compression caps 1 are pushed toward each other by a force F as illustrated in FIG. 3. The resilient element 4 is comprised of multiple superimposed discs of expanded plastic that are kept in place between the frame flanges 2 by virtue of the anchoring rods 3.

The applications of the invention are not limited by the details of the above-described exemplifying embodiment, but rather, can be varied within the scope of the appended claims. Thus, the resilient element need not necessarily be comprised of multiple discs of expanded plastic, but a single block of expanded plastic can be used as well.

What is claimed is:

1. A muscle exerciser for compression between the hands and for exercise of muscles of the body, the muscle exerciser comprising:
   - two cup-shaped compression caps for fitting with palms of the hands;
   - two parallel frame flanges on which the compression caps are mounted;
   - anchoring rods disposed between the frame flanges so as to keep the frame flanges parallel and to permit a predetermined length of axial movement between the frame flanges;
   - a plurality of superimposed discs of expanded plastic forming a resilient expanded plastic element for keeping the frame flanges pushed to axial end positions to create resiliency when the compression caps are pushed toward each other by the user of the muscle exerciser.

2. A muscle exerciser as defined in claim 1, wherein the plurality of superimposed discs are of a plurality of colors.

3. A muscle exerciser as defined in claim 1, wherein six evenly spaced anchoring rods are disposed between the frame flanges.

4. A muscle exerciser as defined in claim 1, wherein the frame flanges are substantially planar.

5. A muscle exerciser as defined in claim 4, wherein the cup-shaped compression caps fit with the substantially planar frame flanges so as to define interior chambers between respective frame flanges and cup-shaped compression caps.

6. A muscle exerciser as defined in claim 5, wherein the anchoring rods extend into and out of the chambers defined by the cup-shaped compression caps and frame flanges when the muscle exerciser is compressed and released.

7. A muscle exerciser as defined in claim 6, wherein the anchoring rods comprise stops at the ends thereof for stopping the movement of the anchoring rods in an axial direction when the muscle exerciser is released.

8. A muscle exerciser as defined in claim 1, wherein the cross section of the exerciser is substantially circular.

* * * * *